US005475363A

United States Patent [19]

Suzuki et al.

[11] Patent Number: 5,475,363

[45] Date of Patent: Dec. 12, 1995

[54] DISASTER PREVENTION MONITORING APPARATUS

[75] Inventors: Munemasa Suzuki; Kiyoaki Koyama; Takashi Shimokawa, all of Tokyo, Japan

[73] Assignee: Hochiki Corporation, Tokyo, Japan

[21] Appl. No.: 212,854

[22] Filed: Mar. 15, 1994

[30] Foreign Application Priority Data

Mar. 16, 1993 [JP] Japan ..... 5-054503

[51] Int. Cl.[6] ..... G08B 29/00

[52] U.S. Cl. ..... 340/506; 340/505; 340/538; 340/425.1; 340/310.01; 340/825.06

[58] Field of Search ..... 340/505–511, 514, 340/538, 825.06–825.13, 825.54, 310.01, 425.1

[56] References Cited

U.S. PATENT DOCUMENTS

| | | | |
|---|---|---|---|
| 4,068,105 | 1/1978 | Jain et al. | 179/175.3 |
| 5,008,662 | 4/1991 | Tokizane et al. | 340/825.06 |
| 5,086,293 | 2/1992 | Takahashi et al. | 340/506 |

FOREIGN PATENT DOCUMENTS

| | | |
|---|---|---|
| 2634928 | 7/1988 | France . |
| 63-39820 | 10/1988 | Japan . |
| 8703406 | 6/1987 | WIPO . |
| 9109391 | 6/1991 | WIPO . |

*Primary Examiner*—Donnie L. Crosland

*Attorney, Agent, or Firm*—Sughrue, Mion, Zinn, Macpeak & Seas

[57] ABSTRACT

A disaster prevention monitor is disclosed in which the power consumption during a line monitoring process is reduced, and a disconnection or a short circuit of control lines can be detected by using a single switching means. A central station has a monitor command transmitter for transmitting a monitor command signal to initiate monitoring of power and control lines. A terminal or repeater station has circuitry for controlling the connection of control lines between a line monitor and power lines. During normal conditions, the control lines are not connected to the power lines, but become so connected only in response to a command from the central station. A line monitoring command causes generation of a negative voltage which is applied to line monitoring circuitry to actuate such circuitry for monitoring the status of the power and control lines.

32 Claims, 10 Drawing Sheets

DISASTER PREVENTION MONITORING APPARATUS

BACKGROUND OF THE INVENTION

1. Field of the Invention

The present invention relates to a disaster prevention monitoring apparatus which monitors an abnormal state such as a fire, and which remotely controls terminal devices such as zone bells, fire doors and the like when the abnormal state occurs.

2. Description of the Related Art

Examined Japanese Utility Model Application No. Sho. 63-39820 discloses a conventional fault detection circuit for a bell line as shown in FIG. 1, including: a bell B to which a diode is connected in series between first terminal B+ and second terminal B–, and resistor Re and diode De connected in parallel therewith; a first switch Q1 which is connected in series between the first terminal and a positive power source, and which is turned on by a fire signal; a second switch Q2 which is connected in series between the second terminal B– and a negative power source, and which is turned on by the fire signal; a monitor current detection circuit Q3 connected between the first terminal B+ and the negative power source; and a voltage detection circuit Q4 connected between the first terminal B+ and the negative power source.

In the conventional fault detection circuit, during a normal monitor period, a positive voltage is output from the positive power source to the second terminal so that a monitor current flows to turn on the monitor current detection circuit.

When the bell lines are disconnected, the monitor current does not flow so as to turn off the monitor current detection circuit, thereby detecting the disconnection state. When the bell lines are shortcircuited, the voltage detection circuit is turned on.

When a fire breaks out, the first and second switches are on to invert the polarity so that the positive voltage is applied to the first terminal to ring the bell. At this time, the monitor current detection circuit and the voltage detection circuit is turned off.

However, in the conventional fault detection circuit for a bell line, a current is always supplied to lines so as to detect a disconnection or a shortcircuit of the lines. Accordingly, there is a problem that the current for monitoring the lines is consumed even during a normal monitor period.

Furthermore, since two switching devices for inverting the polarity of the terminals are required, the two switching devices must be controlled simultaneously. In other words, there is another problem that, when a plurality of bell lines are connected to such a detection circuit, switching devices for inversion corresponding to the plurality of bell lines are required.

SUMMARY OF THE INVENTION

It is an object of the present invention to provide a low-cost disaster prevention monitor, which can suppress current consumption during a line monitor period, and can detect a disconnection or a shortcircuit of the lines by using only a single switching device without a plurality of switching devices for inverting the polarity.

FIG. 2 is a block diagram illustrating the principle of the present invention.

The invention is directed to a disaster prevention monitor in which receiving unit 10 transmits to terminals 11 a command signal, including commands and a terminal address, and the terminal 11, which is so addressed, drives and controls control loads 26 connected thereto on the basis of the received command signal. In the disaster prevention monitor, the receiving unit 10 has a monitor command unit 28A for transmitting a monitor command signal for monitoring a line, and a switch control unit 46A which connects the terminal to first contact at which the control is not conducted on the control load 26, and which is switched from the first contact to second contact in response to a command signal from the receiving unit 10 to supply power to the control load 26; negative-voltage generator 62 which is connected to a power line to be charged by a power source voltage, and which is connected to the first contact and a ground line in response to the monitor command signal, to generate a negative voltage; and monitors 58 and 60 which are driven by the negative voltage generated by the negative-voltage generator 62, and which detect a line voltage to monitor a line state.

According to the disaster prevention monitor of the invention, in a normal monitor state, the switch control unit 46A connects the terminal 11 to first contact at which the control is not conducted on the control loads 26 to turn on the switching devices of the monitors 58, 60 so that the negative-voltage generator generates the negative-voltage to drive the monitor 58, 60 to monitor the line state. Therefore, it is not required to always supply the monitor current to the lines, and hence the current consumption during the line monitor process can be suppressed.

Unlike the prior art, furthermore, it is not required to dispose plural switching devices for inverting the polarity in order to drive the control load, and a disconnection or a shortcircuit of the lines can be detected by using a single switching means.

As a result, the cost of the disaster prevention monitor can be reduced.

PREFERRED EMBODIMENTS OF THE INVENTION

The preferred embodiment of the present invention will be described as follows.

Figure 1:
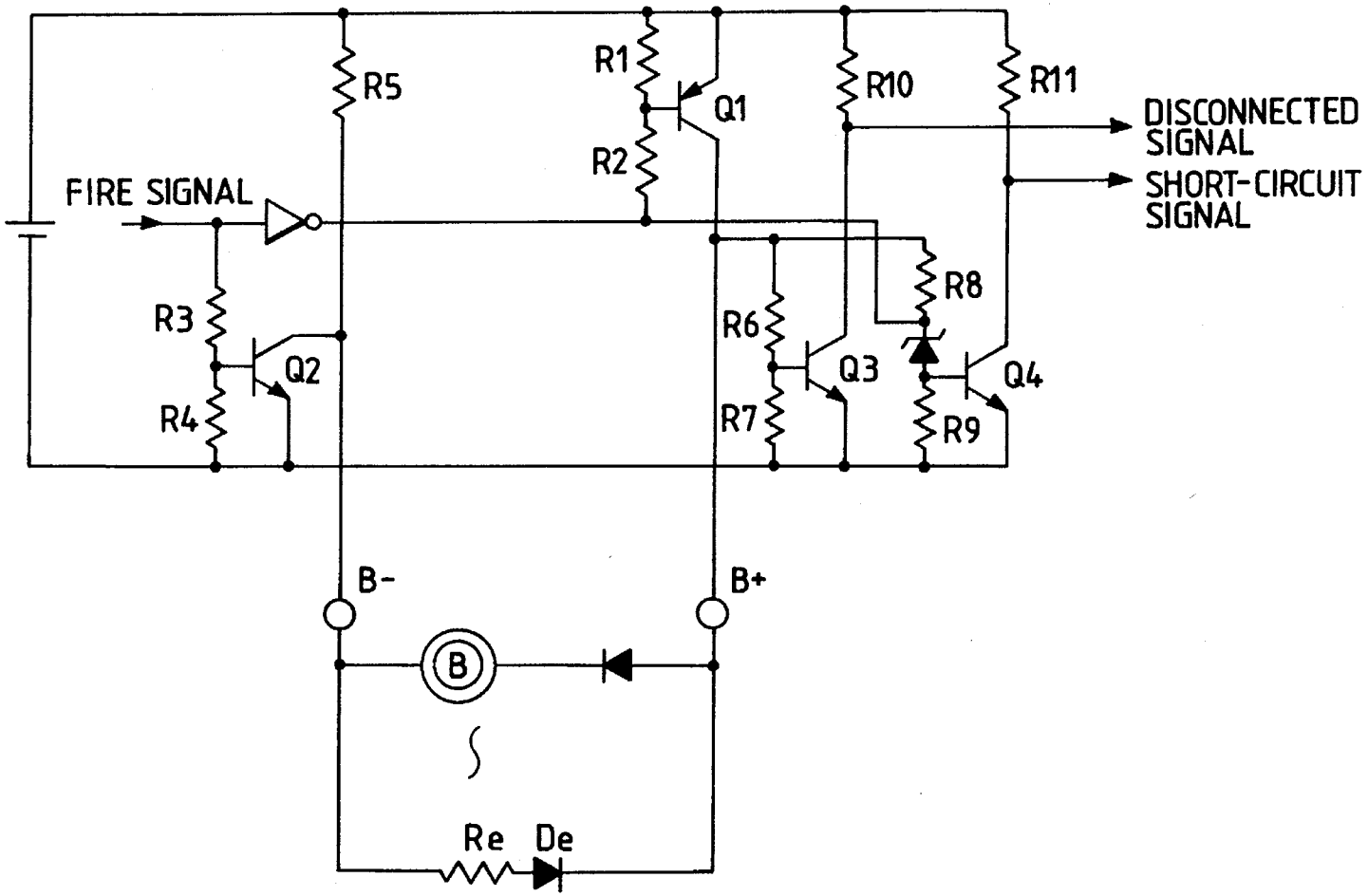
FIG. 1 PRIOR ART
FIG. 1 is a explanatory view showing a conventional fault detection circuit for a bell line.
Figure 2:
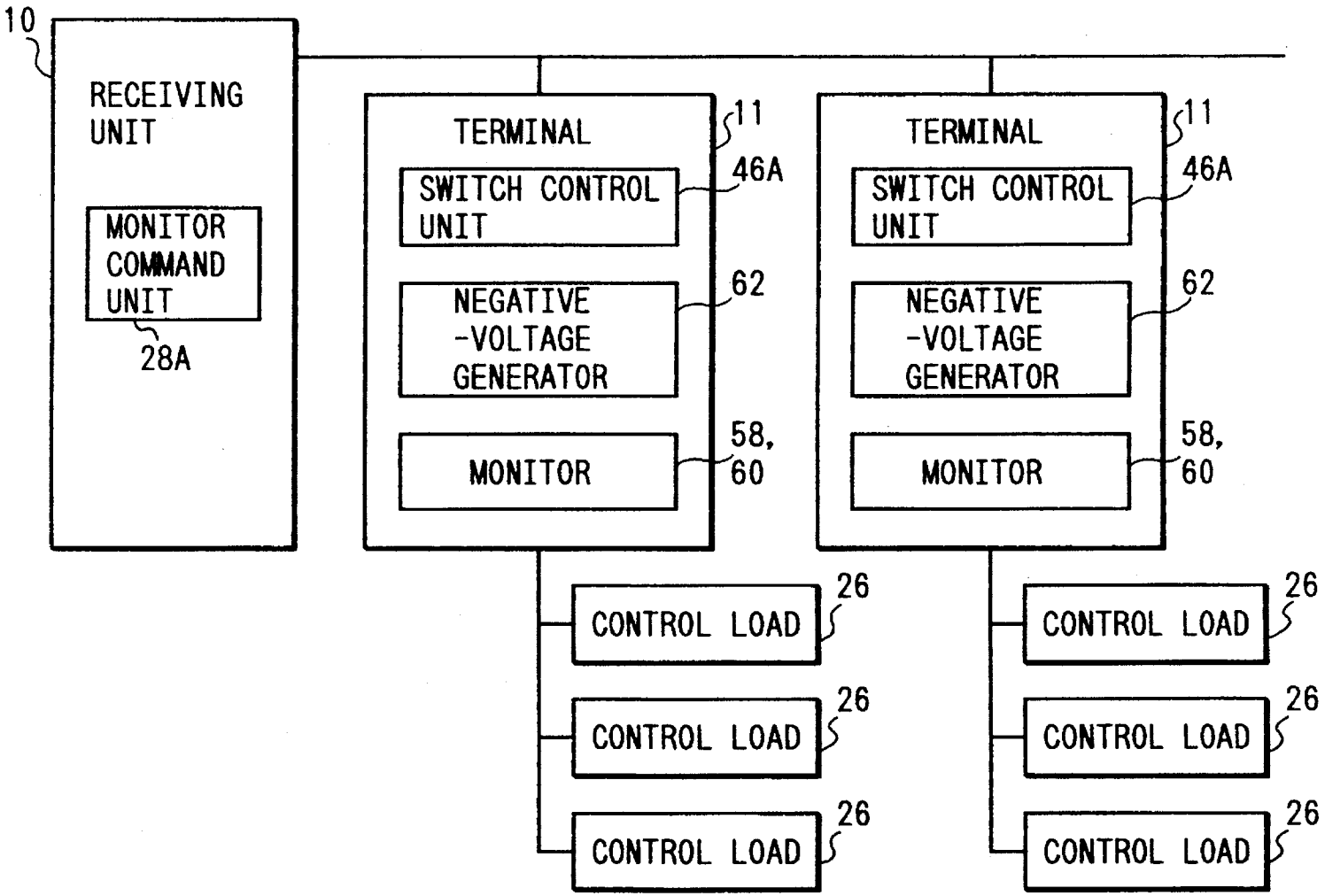
FIG. 2 is a block diagram illustrating the principle of the invention.
Figure 3:
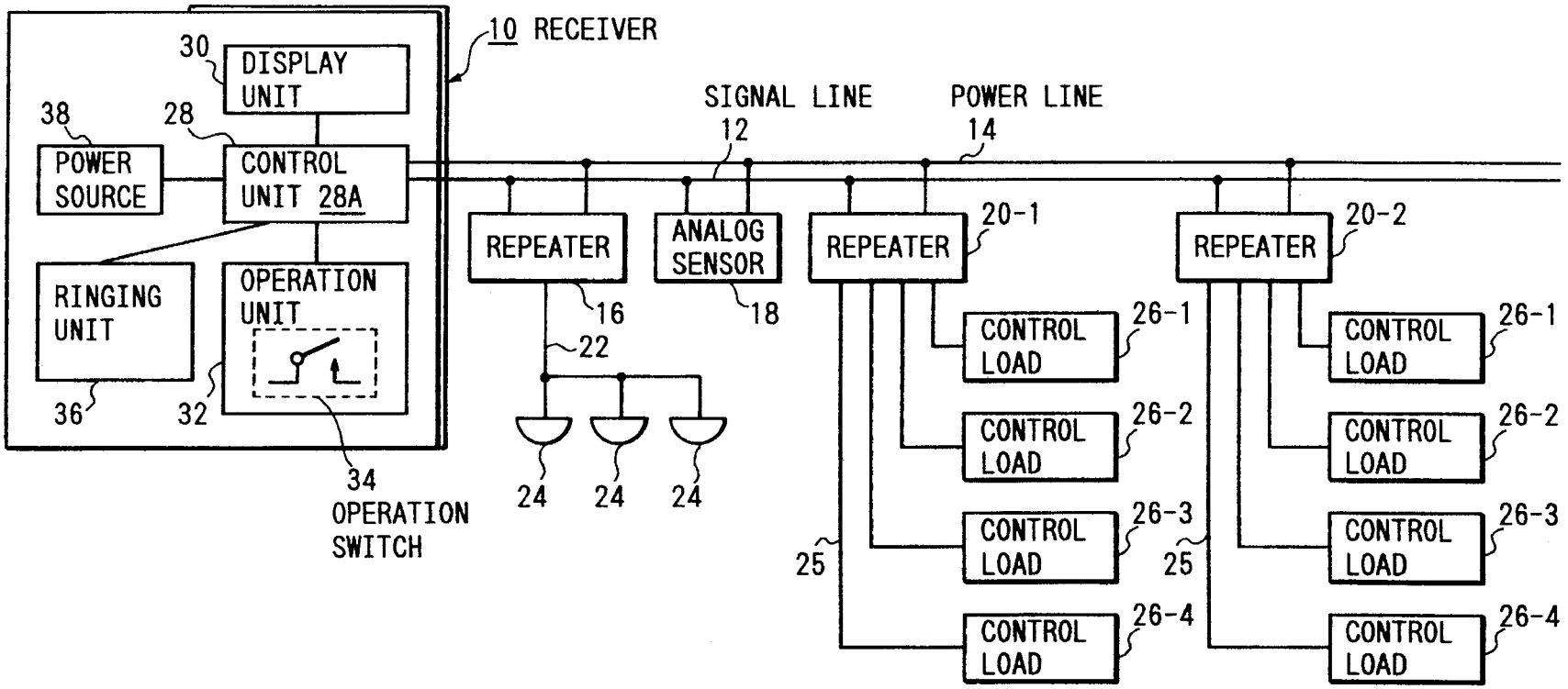
FIG. 3 is a diagram showing the configuration of an embodiment of the invention.

FIG. 3 is a diagram illustrating the whole configuration of a disaster prevention monitor according to an embodiment of the invention.

In FIG. 3, a reference numeral 10 designates a receiver or central station which is disposed in a central monitor room, a building manager room or the like. A signal line 12 functioning as a transmission line and a power line 14 extend from the receiver 10. A sensor repeater 16, an analog sensor 18, and control repeaters 20-1 and 20-2 are connected to the lines. A power and signal line 22 extends from the sensor repeater 16, and one or plural on-off sensors 24 are connected to the power and signal line 22.

The analog sensor 18 functions as a repeater so that analog signals detected by sensors, such as a heat sensor or a smoke sensor, are transmitted to the receiver 10. In the embodiment, four control loads 26 are connected through control lines 25 to each control repeater 20. The control loads 26 may be various disaster prevention apparatus, such as a fire door release, a solenoid or motor for driving a damper of a smoke stop and exhaust port, and the like.

The receiver 10 has a control unit 28 comprising a CPU. A display unit 30, an operation unit 32, a ringing unit 36, and a power source 38 are connected to the control unit 28. The control unit 28 of the receiver 10 produces a message which has a format including a terminal address and a control command, and transmits the message along the signal line 12 so that a polling is conducted on the sensor repeater 16, the analog sensor 18, and the control repeaters 20-1 and 20-2.

The sensor repeater 16, the analog sensor 18, and the control repeaters 20-1 and 20-2 are previously assigned unique terminal addresses, respectively. When a terminal address transmitted from the receiver 10 coincides with the self address of one of the terminals, the terminal executes the process commanded by the received command signal. In this case, when a command instructing the terminal to send detected information is included in the polling conducted in a normal state, either the sensor repeater 16 and the analog sensor 18 produces reply data of detected information, and sends it together with its self address to the receiver 10.

During the normal period, each control repeater 20 conducts a line monitor and control process in response to a line monitor command. When a fire breaks out, each control repeater 20 receives its self terminal address and then a control command for driving the control loads 26, and drives the control loads 26 in accordance with the received control command.

The operation unit 32 of the receiver 10 has a manual operation switch 34. When the operation switch 34 is manually operated, a monitor circuit, to be described later, for monitoring the line state is driven.

The control unit 28 of the receiver 10 functions as a monitor command unit 28A, which provides instructions as to the line state to be monitored and periodically transmits a line monitor command signal at preset intervals of time, for example, 1 sec.

Figure 4:
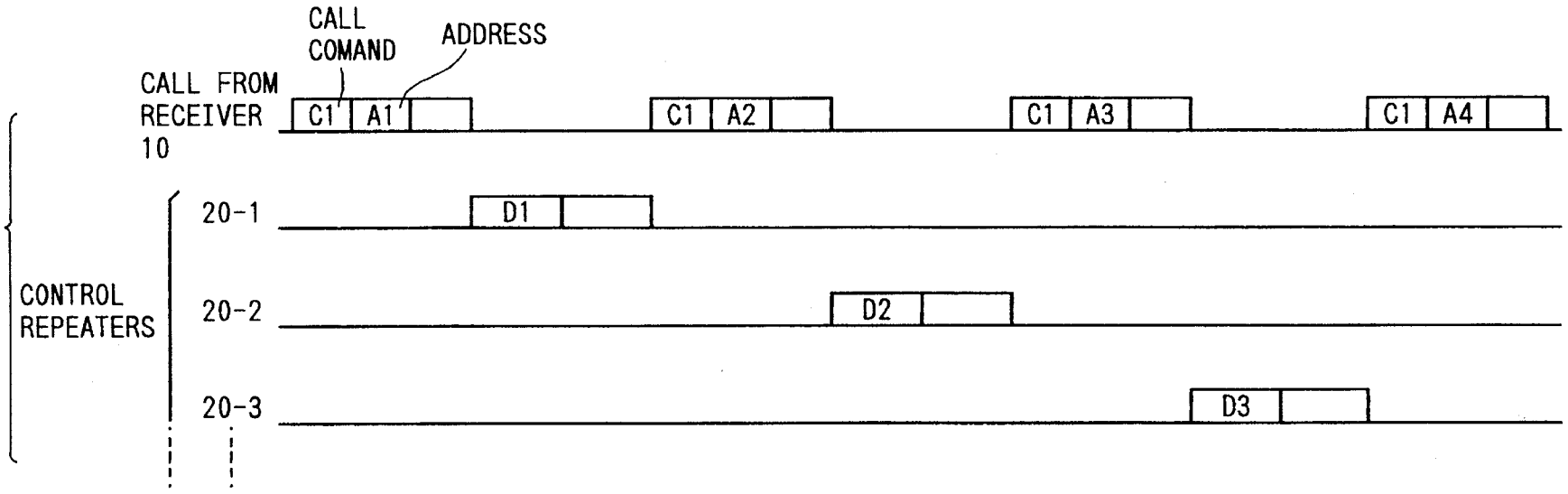
FIG. 4 is a view showing transmission operations conducted between a receiver and repeaters.

FIG. 4 is a timing chart showing calling and replying operations which are conducted in a normal monitor state between the receiver 10 and the repeaters shown in FIG. 3.

Figure 5:
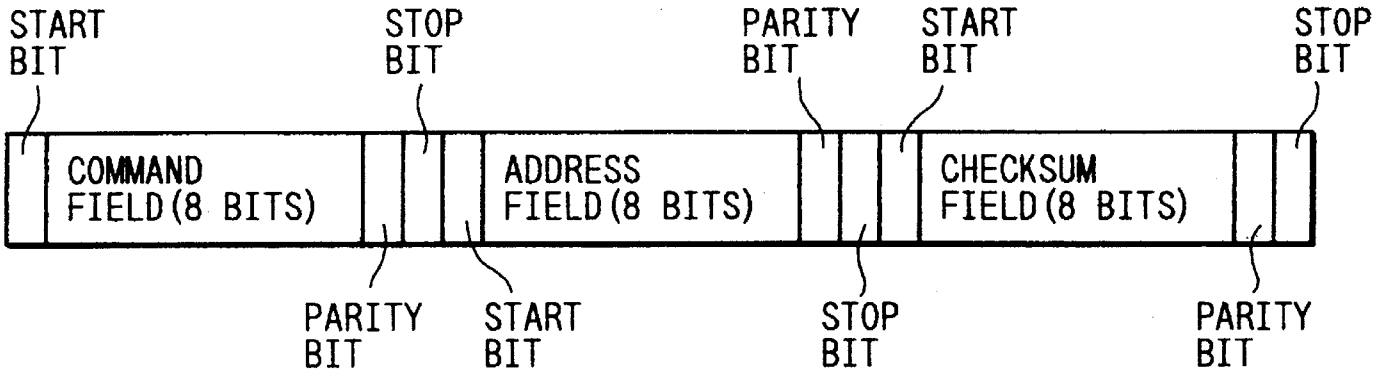
FIG. 5 illustrates the transmission format of a message from a receiver.

In FIG. 4, the receiver 10 transmits in sequence call signals, each including a call command C1 and one of the terminal addresses, A1, A2, A3, A4, . . . As shown in FIG. 5, each call signal comprises 3 bytes of an 8-bit command field, an 8-bit address field, and an 8-bit checksum field. A start bit is disposed before each byte, and a parity bit and a stop bit are disposed after each byte. The command field indicates to all terminals the meaning of a call signal from the receiver 10, irrespective of the address. In the line monitor process, the call signal includes a line monitor command in the command field and a message designating all addresses in the address field. This call signal is transmitted to all the terminals.

Figure 6:
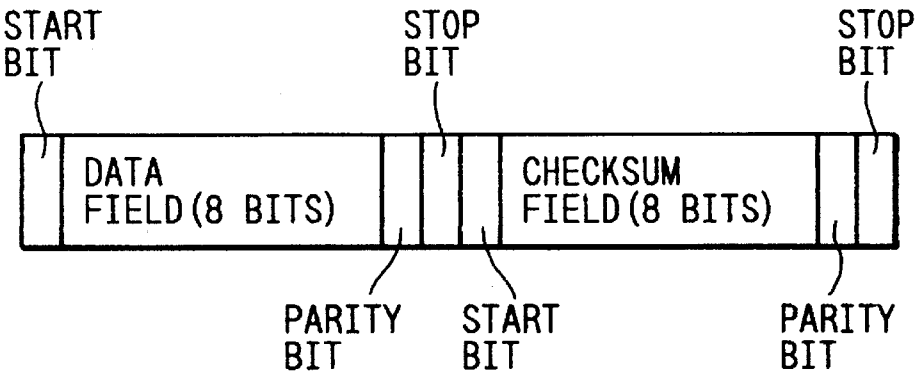
FIG. 6 illustrates the transmission format of a message from a repeater.

When the address included in the call signal from the receiver 10 matches a certain terminal address, the addressed terminal transmits a reply signal, as shown in FIG. 4 by the timing diagrams adjacent the words, "control repeaters 20-1, 20-2 and 20-3." As shown in FIG. 6, a terminal reply signal consists of 2 bytes of an 8-bit data field and an 8-bit checksum field. A start bit is disposed before each byte, and a parity bit and a stop bit are disposed after each byte.

Figure 7:
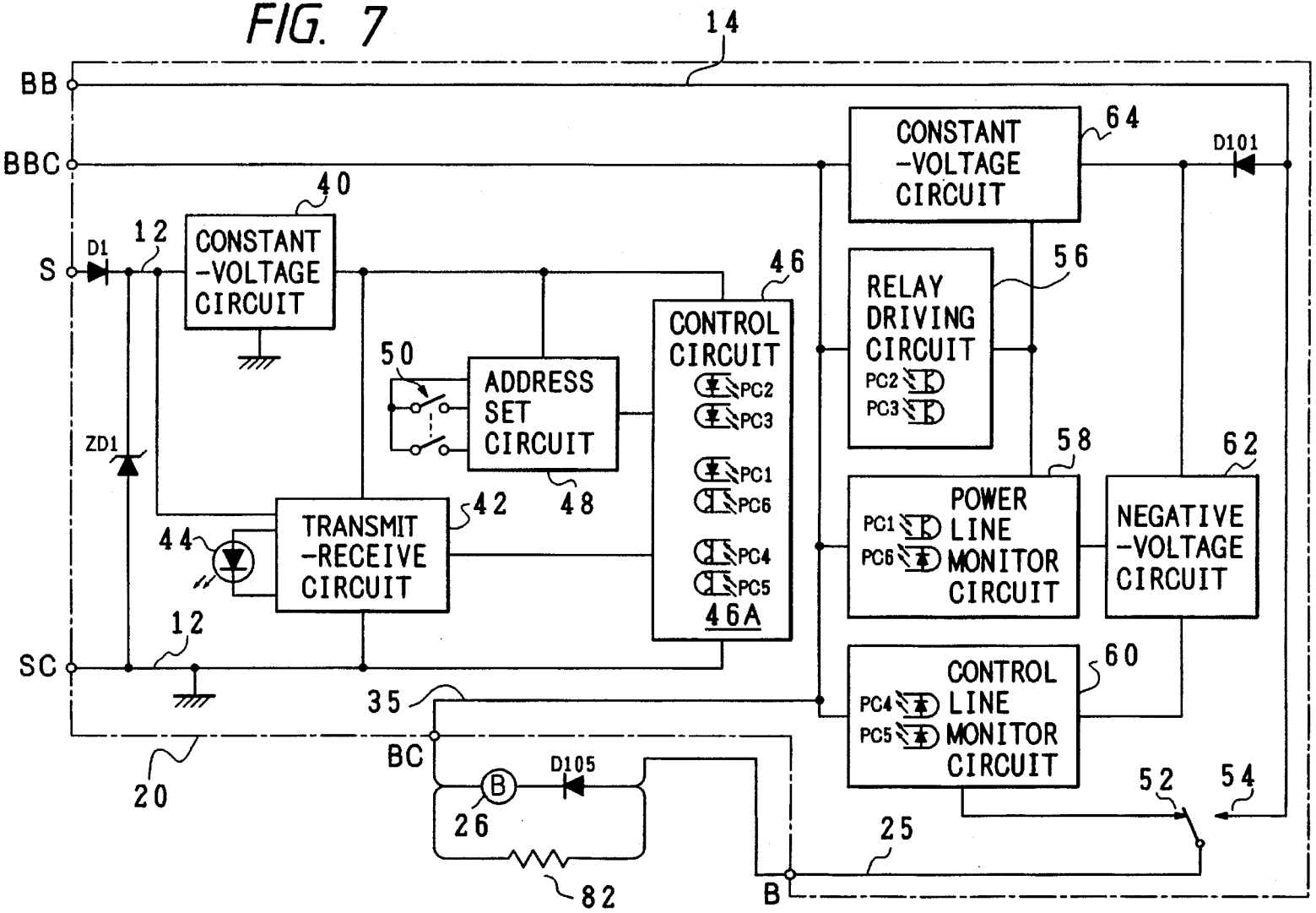
FIG. 7 is a block diagram of a control repeater.

FIG. 7 is a block diagram of an embodiment of any of the control repeaters 20 of FIG. 3.

In the drawing, a pair of signal lines 12 are connected to terminals S and SC of the control repeater 20. A diode D1 and a zener diode ZD1 for absorbing an electrical surge are connected to the terminals S and SC, and a constant-voltage circuit 40 is disposed in the next stage. The constant-voltage circuit 40 generates a DC voltage of 3.2 V required for operating a control IC and other circuitry. A transmit-receive circuit 42 is disposed in the next stage of the constant-voltage circuit 40. A transmission indicator lamp 44 is connected to the transmit-receive circuit 42.

The transmit-receive circuit 42 detects data transmitted from the receiver 10 via signal lines 12 and applies the received signal to a control circuit 46. The transmit-receive circuit 42 converts data transmitted from the control circuit 46 into a current signal so as to output it to the signal lines 12. An address set circuit 48 is connected to the control circuit 46. The address set circuit 48 has an address set switch 50, realized by DIP switches, which set predetermined terminal addresses, more specifically, the address of the group to which the repeater belongs and a unique terminal address.

In the case where the command signal from the receiver 10 collectively designates all addresses, the control circuit 46 responds as if the unique terminal address were included in the command signal, irrespective of the set state of the address set circuit 48.

The control circuit 46 functions as the switch control means 46A, which connects line 25 selectively to a first contact 52, under which condition there is no control of the control loads 26, and to a second contact 54 in response to a control signal from the receiving means 10, to supply power to the control loads 26. The control circuit decodes and detects the various addresses and command signals received in a conventional manner and actuates certain photocouplers which emit light to signal other components that are not connected to the signal lines. The circuit 46 also has photocouplers which receive light emitted from other components and signals the receiver 10 accordingly.

Specifically, when a photocoupler PC3 of the control circuit 46 emits light, a photocoupler PC3 of a relay driving circuit 56 receives the emitted light therefrom, and a reset coil RES (FIG. 8) is energized to reset a latching relay, whereby a connection is made between line 25 and the first contact 52. Thereafter, even when the reset coil RES is deenergized, the connection made to the first contact 52 is mechanically held.

Figure 8:
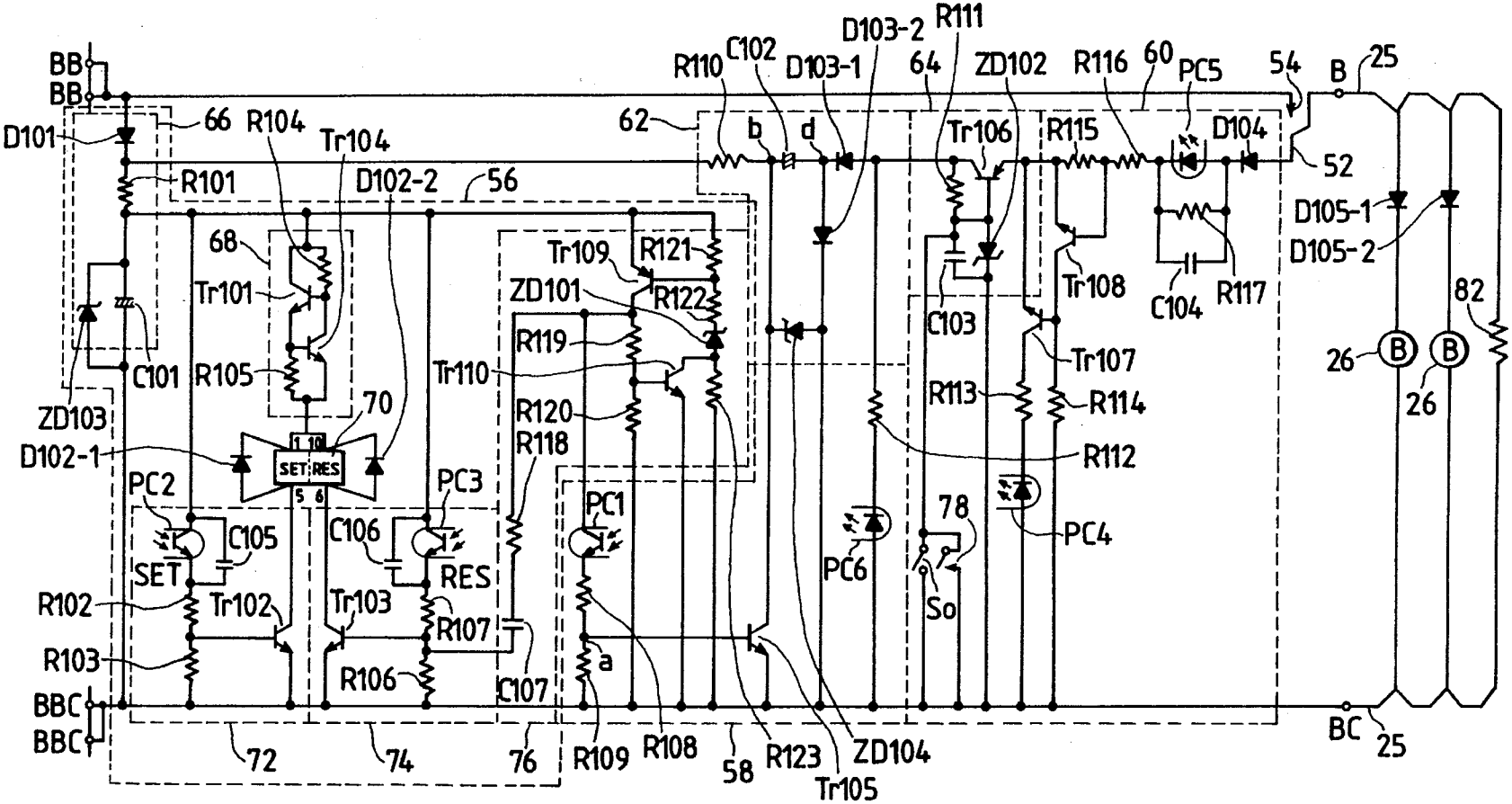
FIG. 8 is a circuit diagram showing a disconnection and shortcircuit detection circuit.

On the other hand, in order to switchover the connection from the first contact 52 to the second contact 54, it is required to energize a set coil SET (FIG. 8). When a photocoupler PC2 of the control circuit 46 emits light, a photocoupler PC2 of the relay driving circuit 56 receives the emitted light, and the set coil SET is energized to set the latching relay, whereby a connection is made to the second contact 54.

The reference numeral 58 designates a power line monitor circuit which functions to monitor the line state of the power line 14.

When the control circuit 46 decodes the line monitor command signal, which is transmitted from the receiver 10 at intervals of 1 sec., a photocoupler PC1 of the control circuit 46 emits light for a predetermined period, e.g., 1 msec., and a photocoupler PC1 of the power line monitor circuit 58 receives the emitted light to drive a switching unit which will be described later. The power line monitor circuit 58 is driven by turning on of the switching unit to monitor the power line 14. When there is nothing abnormal about the power line 14, a photocoupler PC6 of the power line monitor circuit 58 emits light, and a photocoupler PC6 of the control circuit 46 receives the emitted light. Then, the control circuit 46 informs the receiver 10 of the normal state of the power line 14 through the transmit-receive circuit 42.

The reference numeral 60 designates a control line monitor circuit. A photocoupler PC4 of the control line monitor circuit 60 emits light when the control lines 25 are disconnected from the control line monitor circuit, and a photocoupler PC5 emits light when the control lines 25 are shortcircuited. A photocoupler PC4 of the control circuit 46 receives light emitted from the photocoupler PC4 of the control line monitor circuit 60, and a photocoupler PC5 of the control circuit 46 receives light emitted from the photocoupler PC5 of the control line monitor circuit 60. The control circuit 46 determines the disconnection or shortcircuit state of control lines 25 and informs the receiver 10 of the state of control lines 25 through the transmit-receive circuit 42.

The reference numeral 62 designates a negative-voltage circuit, which is charged through a diode D101 connected to the power line 14. When the switching unit switches to the on state, the negative-voltage circuit 62 generates a negative voltage by which the power line monitor circuit 58 and the control line monitor circuit 60 are driven.

The reference numeral 64 designates a constant-voltage circuit which maintains the negative voltage generated by the negative-voltage circuit 62, at a fixed level.

FIG. 8 shows a specific circuit configuration of the relay driving circuit 56, the power line monitor circuit 58, the control line monitor circuit 60, the negative-voltage circuit 62, and the constant-voltage circuit 64, all of which are shown in block form in FIG. 7.

In FIG. 8, the relay driving circuit 56 comprises: (1) a power source voltage supply circuit 66 comprising the diode D101, a resistor R101, a capacitor C101, and a zener diode ZD103; (2) a current-limiting circuit 68 comprising transistors Tr101 and Tr104, and resistors R104 and R105; (3) the latching relay 70 having the reset coil RES, the set coil SET, and diodes D102-1 and D102-2; (4) a set circuit 72, for setting the latching relay 70, comprising the photocoupler PC2, a capacitor C105, resistors R102 and R103, and a transistor Tr102; (5) a reset circuit 74, for resetting the latching relay 70, comprising the photocoupler PC3, a capacitor C106, resistors R106 and R107, and a transistor Tr103; and (6) a driving voltage supply circuit 76, for supplying a driving voltage to a transistor Tr105 (switching unit), comprising transistors Tr109 and Tr110, resistors R118, R119, R120, R121, R122, and R123, a zener diode ZD101, and a capacitor C107.

When a voltage is applied between terminals BB and BBC and the charging voltage of the capacitor C101 rises, a current flows through a path of the positive terminal of the capacitor C101, the transistor Tr109, the resistors R121 and R122, the zener diode ZD101, the resistor R123, and the negative terminal of the capacitor C101.

At this time, also the transistor Tr110 is turned on. Therefore, the voltage drop due to the resistor R123 is taken up, resulting in the charging voltage of the capacitor C101, obtained when the transistor Tr109 is turned off, being lower than that obtained when the transistor Tr109 is turned on. In this way, when powered on, the transistor Tr109 is turned on to cause current to flow into the resistor R118, the capacitor 107 and the resistor 106 to turn on the transistor 103 to reset the latching relay 70 forcibly so that the connection is made between control lines 25 and the first contact 52.

The turn-on of the transistor Tr109 causes a transient current to flow through the RC circuit comprising the capacitor C107 and the resistor R106, whereby a reset pulse is applied to the transistor Tr103. As a result, the transistor Tr103 is temporarily turned on and thereafter turned off. During the normal monitor period, the transistors Tr109 and Tr110 remain turned on.

When the receiver 10 issues a command signal for driving the control loads 26, the photocoupler PC2 of the control circuit 46 as shown in FIG. 7 emits light, and the photocoupler PC2 of the relay driving circuit 56 receives the emitted light. Then, the transistor Tr102 is turned on to set the latching relay 70. As a result, the connection of lines 25 is switched from the first contact 52 to the second contact 54, whereby power via power lines 14 will be applied to control loads 26.

In contrast, when the receiver 10 issues a command signal for decoupling the control loads 26, the photocoupler PC3 of the control circuit 46 as shown in FIG. 7 emits light, and the photocoupler PC3 of the relay driving circuit 56 receives the emitted light. Then, the transistor Tr103 is turned on to reset the latching relay 70. As a result, the control lines 25 are switched from the second contact 54 to the first contact 52.

The reference numeral 58 designates the power line monitor circuit 58 which comprises the photocouplers PC1 and PC6, resistors R108, R109, and R112, and the transistor Tr105 which functions as the switching means.

When the photocoupler PC1 of the control circuit 46 as shown in FIG. 7 emits light at an interval of, for example, 1 sec., the photocoupler PC1 of the power line monitor circuit 58 receives the emitted light, causing the transistor Tr105 to be turned on and off.

When the transistor Tr105 is turned on, the positive terminal of the capacitor C102 is connected to ground. Therefore, the negative terminal of the capacitor C102 is at a negative level as seen from the ground. As a result, the photocoupler PC6 is biased by the charging voltage of the capacitor C102 to emit light so that the normal signal is sent to the photocoupler PC6 of the control circuit 46. When there is abnormal condition on the power line, such as a disconnection or a shortcircuit, the photocoupler PC6 does not emit light, and therefore the photocoupler PC6 of the control circuit 46 cannot receive light, whereby the control circuit 46 detects the abnormal state of the power line.

The reference numeral 62 designates the negative-voltage circuit 62 which comprises a resistor R110, the capacitor C102, diodes D103-1 and D103-2, and a zener diode ZD104.

The capacitor C102 is charged through the resistor R110 by the power source voltage of the power line 14. When powered on, the charging current of the capacitor C102 flows through the diode D103-2 to the ground line. Since the positive terminal of the capacitor C102 is connected to the ground when the transistor Tr105 is turned on, a negative voltage appears at the negative terminal of the capacitor C102. The generated negative voltage allows the charging voltage of the capacitor C102 to be supplied to the power line monitor circuit 58 and the control line monitor circuit 60.

The reference numeral 64 designates the constant-voltage circuit which comprises a transistor Tr106, a Zener diode ZD102, a resistor R111, and a capacitor C103. The constant-voltage circuit 64 stabilizes the negative voltage generated by the negative-voltage circuit 62 and supplies the stabilized voltage to the control line monitor circuit 60.

The control line monitor circuit 60 comprises the photocouplers PC4 and PC5, resistors R113, R114, R115, R116, and R117, transistors Tr107 and Tr108, a capacitor C104, a diode D104, a third contact 78, and a fourth contact 80.

During a normal state, namely when terminals B and BBC are terminated by a resistor (terminator portion) 82 having a predetermined impedance and control lines 25 are connected via contact 52 to the control line monitor circuit, if the negative-voltage circuit 62 generates a negative voltage, the photocoupler PC5 is not supplied with a current of a level sufficient for emitting light so that the photocoupler PC5 becomes inactive. However, a current flows into the base of the transistor Tr108 to turn it on. When the transistor Tr108 is turned on, the transistor Tr107 is turned off so that also the photocoupler PC4 becomes inactive. In this way, during a normal state, both the photocouplers PC4 and PC5 are inactive.

In contrast, when the control lines 25 are disconnected from contact 52, no current flows into the base of the transistor Tr108. Therefore, the transistor Tr108 is turned off so that a current flows into the base of the transistor Tr107 via the terminal BBC and the resistor R114 to turn on the transistor Tr107. Consequently, the photocoupler PC4 emits light to transmit a disconnection signal to the photocoupler PC4 of the control circuit 46 as shown in FIG. 7.

When the control lines 25 are shortcircuited (and connected to contact 52), a current flows to turn on the photocoupler PC5 without the effect of the impedance of the resistor (terminator portion) 82 so that the photocoupler PC5 emits light, and a shortcircuit signal is transmitted to the photocoupler PC5 of the control circuit 46.

A third contact 78 is opened by the reset operation of the latching relay 70 and closed by the set operation of the relay 70. Accordingly, when the connection is switched from the first contact 52 to the second contact 54, a condition which is similar to that obtained when a disconnection occurs is produced, thereby preventing the photocoupler PC4 from becoming active.

The fourth contact 80 is closed manually. Accordingly, the disconnection and shortcircuit monitor processes can be halted. For example, during construction work, diodes D105-1 and D105-2, which are connected in series to the control loads 26, often fail to be connected in the polarity direction according to the specification. In such a case, the disconnection and shortcircuit monitor process can be halted until the diodes D105-1 and D105-2 are connected properly.

Figure 9:
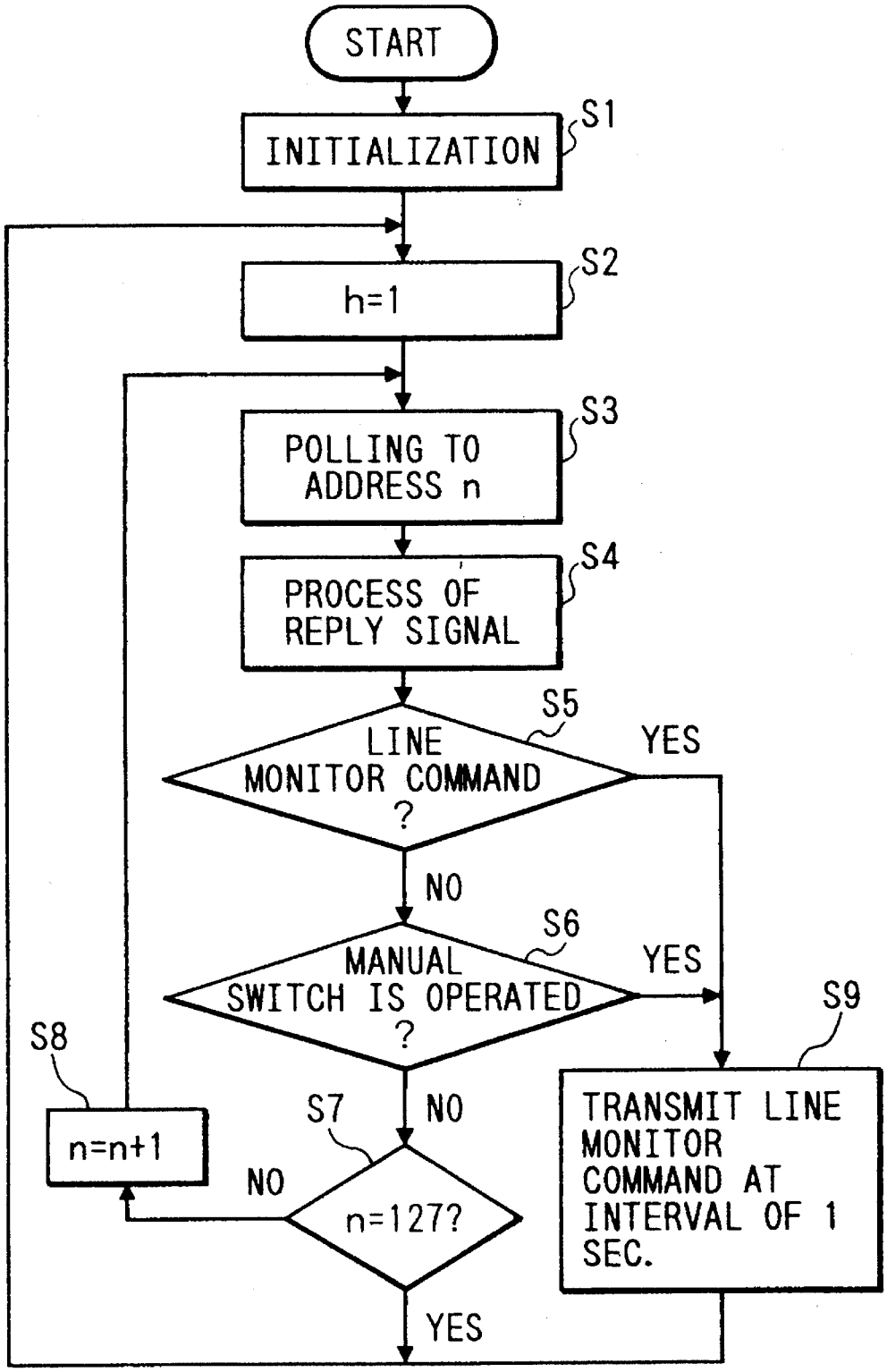
FIG. 9 is a flowchart showing the process of the receiver.

FIG. 9 is a flowchart showing the process of the control unit 28 of the receiver 10.

In the drawing, when the receiver 10 is powered on, a predetermined initialization process is conducted in step S1, and a repeater address n for polling is set n=1 in step S2. Then, in step S3, the terminal polling is conducted on the repeater of address n=1. The receiver waits for a reply, and a process for a terminal reply to the polling is conducted in step S4.

Then, the existence of the line monitor command is judged in step S5. Namely, the control unit sense the presence or absence of a line monitor command on the signal lines. If there is no line monitor command, the process proceeds to step S6 wherein it is checked whether or not the operation switch 34 of the operation unit 32 is operated. If the operation switch 34 is not operated, the process proceeds to step S7 wherein it is judged whether or not the address has reached the final repeater address n=127. If not, the repeater address is incremented by 1 in step S8, and the polling is conducted in step S3 on the next repeater address.

If there is a line monitor command in step S5 or the operation switch 34 is manually operated in step S6, the process proceeds to step S9.

In step S9, the line monitor command signal is generated while collectively designating all the terminal addresses, at an interval of a predetermined period, for example, 1 sec., and transmitted to the control circuit 46 of the control repeater 20.

When the receiver 10 then receives a signal indicating normal state for the power line 14, or a signal indicating a disconnect state or a shortcircuit of the control lines 25, from the control circuit 46 of any control repeater 20, a process such as the display of the received signal on the display unit 30 is conducted in step S4.

Figure 10:
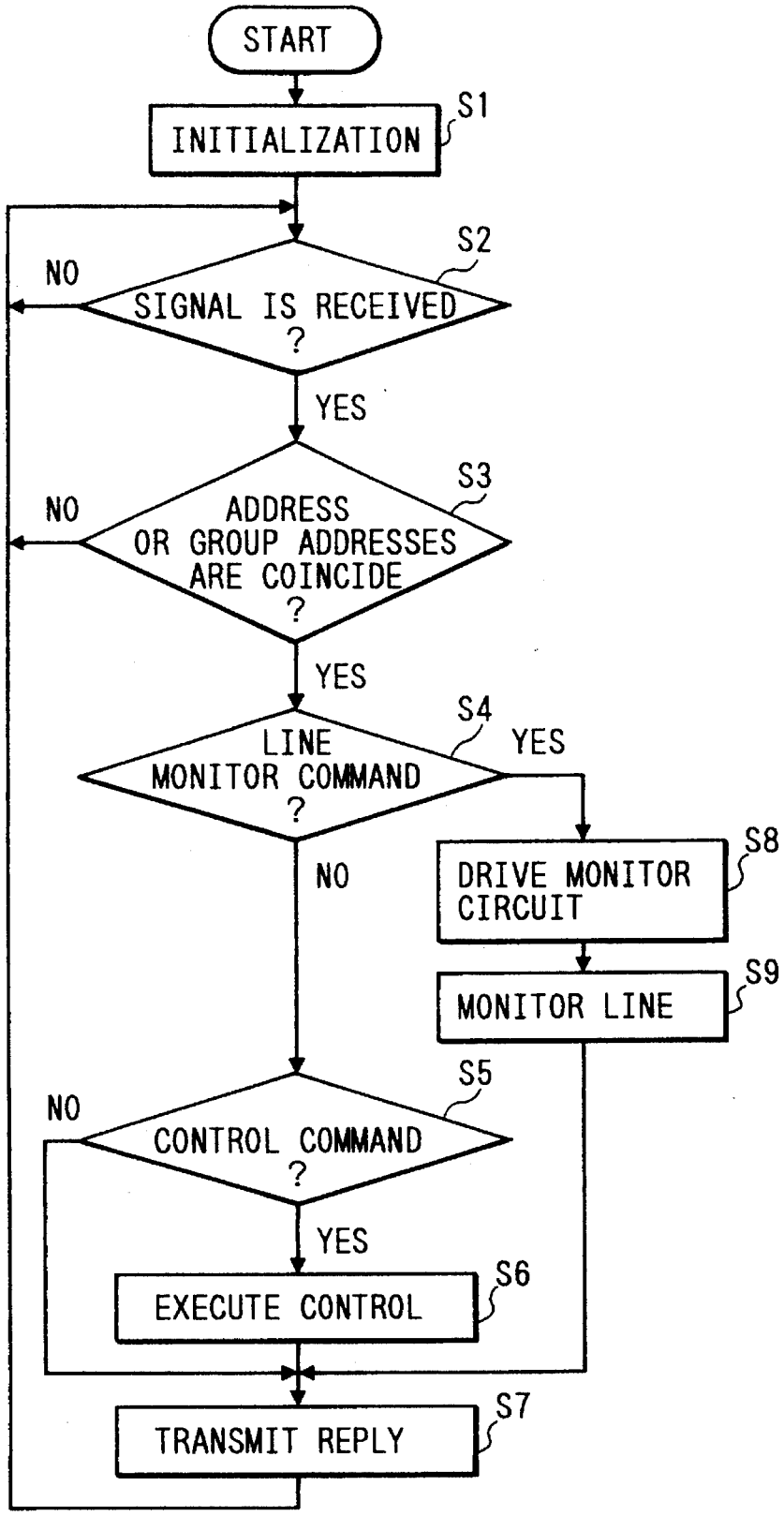
FIG. 10 is a flowchart showing the process of the repeater.

Next, FIG. 10 is a flowchart showing the process of the control repeater 20 shown in FIG. 3.

In FIG. 10, when the control repeater 20 is powered on, a predetermined initialization process is conducted in step S1, and the control repeater 20 awaits in step S2 the transmission of a signal from the receiver 10. When a signal is received, the process proceeds to step S3. In step S3, the coincidence of the received address and the repeater address, or that of the received group address and the address of the group to which the repeater belongs is judged. In the case where the command signal from the receiver 10 collectively designates all the terminal addresses, the coincidence of the addresses is judged in step S3. Also, where the received address is the same as the repeater address, step S3 results in a YES result at the particular repeater that has detected a coincidence.

In step S4, the control circuit of the repeater determines whether or not the command field of the command signal is the line monitor command. If not, in step S5, the control circuit determines whether or not the command field of the command signal is a control command to drive the control load or loads 26. If it is judged in step S5 that the signal is a control command, the process proceeds to step S6 to execute the control of the control loads 26. In the case where the signal includes no line monitor command nor control command, the process jumps directly to step S7. In step S7, if there is no abnormal state, the normal-state reply is sent, but if there is any abnormal state, the abnormal-state reply is sent. The replies are sent along the signal line as previously described.

When the control command is the one for driving the control loads 26, the control circuit 46 of the control repeater 20 decodes it and drives the photocoupler PC2 so as to emit light. The light emitted by the photocoupler PC2 is received by the photocoupler PC2 of the relay driving circuit 56. Then, the transistor Tr102 is turned on to set the latching relay 70 so that the connection is switched from the first contact 52 to the second contact 54, whereby the control lines 25 are connected to power lines 14 and the control loads 26 are driven. This causes a bell to ring in one example, and this state is held until the latching relay 70 is reset.

When the control command is the one for halting the drive of the control loads 26, the control circuit 46 of the control repeater 20 decodes it and drives the photocoupler PC3 so as to emit light. The light emitted by the photocoupler PC3 is received by the photocoupler PC3 of the relay driving circuit 56. Then, the transistor Tr103 is turned on to reset the latching relay 70, so that the connection is switched from the second contact 54 to the first contact 52, whereby the control loads 26 are no longer connected to power lines 14 and, in the case where the control load is a bell, the ringing operation of the bell is stopped.

On the other hand, if the signal is judged in step S4 to be the line monitor command, the power line monitor circuit 58 and the control line monitor circuit 60 are driven in step S8. Specifically, when the control circuit 46 of the control repeater 20 decodes the signal to judge it to be the line monitor command signal, the photocoupler PC1 of the control circuit 46 is driven so as to emit light at an interval of, for example, 1 sec. The light emitted by the photocoupler PC1 is received by the photocoupler PC1 of the power line monitor circuit 58 so that the transistor Tr105 is turned on at an interval of a predetermined period, for example, 1 sec.

Figure 11:
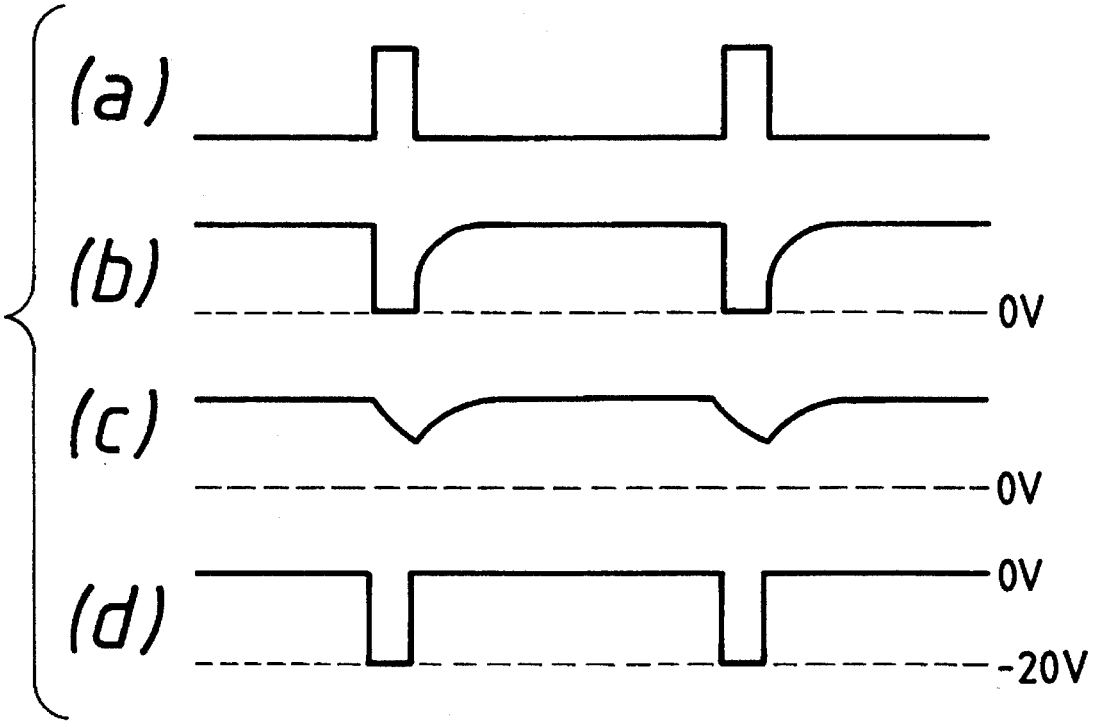
FIG. 11, waveforms (a)–(d) are timing charts showing voltages at various points in the circuit of FIG. 8.

FIG. 11 waveform (a) shows a pulse signal at point a which is input to the transistor Tr105.

The on and off operations of the transistor Tr105 cause the voltage of point b which is between the resistor R110 and the capacitor C102 to vary as shown in FIG. 11 waveform (b). Therefore, the capacitor C102 is charged and discharged in the manner shown in FIG. 11 waveform (c), with the result that a negative voltage shown in FIG. 11 waveform (d) is generated at point d in the negative terminal side of the capacitor C102.

The power line monitor circuit 58 and the control line monitor circuit 60 are driven by the thus generated negative voltage.

In step S9, the power line monitor circuit 58 monitors the state of the power line 14, and the control line monitor circuit 60 monitors that of the control lines 25.

When the power line 14 is normal, the photocoupler PC6 of the power line monitor circuit 58 emits light. The emitted light is received by the photocoupler PC6 of the control circuit 46, and the normal signal is transmitted in step S7 to the receiver 10. When the control lines 25 are disconnected, the photocoupler PC4 of the control line monitor circuit 60 emits light, and, when the control lines 25 are shortcircuited, the photocoupler PC5 emits light. The two kinds of light are respectively received by the photocouplers PC4 and PC5 of the control circuit 46, and the disconnection signal or the shortcircuit signal for the control lines 25 is transmitted in step S7 to the receiver 10.

In the conventional art, in order to detect a disconnection or a shortcircuit of the lines, the monitoring process is conducted while the power is being supplied to the lines, and therefore there will be power consumption even during a normal monitor period. By contrast, according to the present invention, it is not necessary to connect the control lines and control loads to the power lines during normal monitoring, and hence the power consumption is reduced.

Furthermore, in the conventional art, a plurality of switching devices are necessary to invert the polarity. In the present invention, the disconnection or shortcircuit of the control lines can be detected by using a single switching element. As a result, the cost of the disaster prevention monitor can be reduced.

In the embodiment described above, only the receiver 10 is disposed as the receiving unit. In the case where the installation is very large, the monitor may include repeater panels, which are disposed on each floor and function as local receivers and are connected through signal lines to a central receiver disposed in a central monitor room, and the control repeaters 20-1 and 20-2 are connected to each of the repeater panels through the signal line 12 as shown in the receiver 10 of FIG. 3.

In such a large scale system, therefore, the receiving unit includes a receiver and repeater panels which function as local receivers.

In an installation wherein a main receiver for administrating local receivers is not provided and local receivers are distributed on each floor so as to respectively function as a receiver, the receiving means in the invention may be configured by only the local receivers.

As described above, according to the present invention, the monitor unit for monitoring the line state is driven by a negative voltage generated by the negative-voltage generation unit, and therefore the current consumption in the line monitor process can be reduced and the disconnection or shortcircuit of lines can be detected by using a single switching element. Therefore, the cost of the disaster prevention monitor can be reduced.

What is claimed is:

1. A disaster prevention system and monitor comprising:

a central station for transmitting command signals along signal lines;

at least one repeater station connected to said signal lines for receiving said command signals and for transmitting status information signals onto said signal lines;

control loads, control lines connected said control loads at said least one repeater station, and power lines adapted for supplying power to said control loads when connected to said control lines, said control lines normally being disconnected from said power lines;

means at said at least one repeater station, responsive to a command signal including an address field designating said at least one repeater station and a command field designating that power is to be applied to said control loads, for connecting said control lines to said power lines;

monitor means at said at least one repeater station for monitoring, when actuated, the state of said power lines and control lines when said power lines are not connected to said control lines; and means at said at least one repeater station, responsive to a command signal including an address field designating said at least one repeater station and a command field designating that said monitoring means should be activated, for actuating said monitoring means.

2. A disaster prevention system and monitor as claimed in claim 1, wherein said means for actuating said monitor means comprises a negative voltage generating means for supplying a negative voltage to said monitor means.

3. A disaster prevention system and monitor as claimed in claim 1, wherein said means for connecting said control lines to said power lines comprises a switch for switching said control lines between said power lines and said monitor means, with said switch normally connecting said control lines to said monitor means.

4. A disaster prevention system and monitor as claimed in claim 3, wherein said at least one repeater station further comprises means responsive to a command signal including an address field designating said at least one repeater station and a command field designating that said control lines should be disconnected from said power lines for causing said switch to disconnect said control lines from said power lines.

5. A disaster prevention system and monitor as claimed in claim 3, wherein said monitor means comprises a power line monitor for sensing the status of said power line and transmitting a power line normal signal when said power line is in a normal power-up state.

6. A disaster prevention system and monitor as claimed in claim 5, wherein said monitor means further comprises a control line monitor for sensing an abnormal condition of said control line and transmitting a control line abnormal signal when said control line has an abnormal condition.

7. A disaster prevention system and monitor as claimed in claim 6, wherein said abnormal conditions sensed by said control line monitor include disconnection of said control line and short circuit of said control line.

8. A disaster prevention system and monitor as claimed in claim 1, wherein said command signal has a format of an address field and a command field and said central station selectively transmits in said command field the commands to power said control lines, to remove power from said control lines, and to monitor the power and control lines.

9. A disaster prevention system and monitor as claimed in claim 8, wherein said command to monitor the power and control lines is transmitted repetitively at an interval of a predetermined time.

10. A disaster prevention system and monitor as claimed in claim 7, wherein said means for connecting said control lines to said power lines further comprises:

a latching relay having set and reset coils, said coils affecting the switching of said switch;

a command field decoder; and a relay driver circuit responsive to said command field decoder for controlling the energization of said set and reset coils to thereby control the connection of said control lines to said power lines.

11. A disaster prevention system and monitor as claimed in claim 10, wherein said means for actuating said monitor means comprises a negative voltage generating means for supplying a negative voltage to said monitor means.

12. A disaster prevention system and monitor as claimed in claim 11, wherein said means for connecting said control lines to said power lines comprises a switch for switching said control lines between said power lines and said monitor means, with said switch normally connecting said control lines to said monitor means.

13. A disaster prevention system and monitor as claimed in claim 12, wherein said switch comprises a moveable contact connected to said control lines and a first fixed contact connected in said monitor means and a second fixed contact on said power lines, whereby said moveable contact is moveable between said two fixed contacts to selectively connect said control lines to said power lines and to said monitor means.

14. A disaster prevention system and monitor as claimed in claim 11, wherein said negative voltage generating means comprises:

a resistor connected to said power lines;

a capacitor which is charged by the voltage carried by said power lines through said resistor;

a reverse-current blocking diode connected to a negative terminal side of said capacitor and to said first fixed contact; and a diode connected between said negative terminal side and a reference potential.

15. A disaster prevention system and monitor as claimed in claim 14, wherein said central station further comprises manually operable means for initiating a command to control said switch.

16. A disaster prevention system and monitor as claimed in claim 14, further comprising an impedance element disposed parallel with said control loads.

17. A disaster prevention system and monitor as claimed in claim 1, wherein said at least one repeater station is a plurality of repeater stations having respective control loads and control lines connected thereto.

18. A disaster prevention system and monitor as claimed in claim 2, wherein said at least one repeater station is a plurality of repeater stations having respective control loads and control lines connected thereto.

19. A disaster prevention system and monitor as claimed in claim 3, wherein said at least one repeater station is a plurality of repeater stations having respective control loads and control lines connected thereto.

20. A disaster prevention system and monitor as claimed in claim 4, wherein said at least one repeater station is a plurality of repeater stations having respective control loads and control lines connected thereto.

21. A disaster prevention system and monitor as claimed in claim 5, wherein said at least one repeater station is a plurality of repeater stations having respective control loads and control lines connected thereto.

22. A disaster prevention system and monitor as claimed in claim 6, wherein said at least one repeater station is a plurality of repeater stations having respective control loads and control lines connected thereto.

23. A disaster prevention system and monitor as claimed in claim 7, wherein said at least one repeater station is a plurality of repeater stations having respective control loads and control lines connected thereto.

24. A disaster prevention system and monitor as claimed in claim 8, wherein said at least one repeater station is a plurality of repeater stations having respective control loads and control lines connected thereto.

25. A disaster prevention system and monitor as claimed in claim 9, wherein said at least one repeater station is a plurality of repeater stations having respective control loads and control lines connected thereto.

26. A disaster prevention system and monitor as claimed in claim 10, wherein said at least one repeater station is a plurality of repeater stations having respective control loads and control lines connected thereto.

27. A disaster prevention system and monitor as claimed in claim 11, wherein said at least one repeater station is a plurality of repeater stations having respective control loads and control lines connected thereto.

28. A disaster prevention system and monitor as claimed in claim 12, wherein said at least one repeater station is a plurality of repeater stations having respective control loads and control lines connected thereto.

29. A disaster prevention system and monitor as claimed in claim 13, wherein said at least one repeater station is a plurality of repeater stations having respective control loads and control lines connected thereto.

30. A disaster prevention system and monitor as claimed in claim 14, wherein said at least one repeater station is a plurality of repeater stations having respective control loads and control lines connected thereto.

31. A disaster prevention system and monitor as claimed in claim 15, wherein said at least one repeater station is a plurality of repeater stations having respective control loads and control lines connected thereto.

32. A disaster prevention system and monitor as claimed in claim 16, wherein said at least one repeater station is a plurality of repeater stations having respective control loads and control lines connected thereto.

* * * * *